US011131168B2

(12) United States Patent
Badii et al.

(10) Patent No.: US 11,131,168 B2
(45) Date of Patent: Sep. 28, 2021

(54) ORIENTED DETECTION PERFORATING DEVICE

(71) Applicant: Halliburton Energy Services, Inc., Houston, TX (US)

(72) Inventors: Cameron Scott Badii, Fort Worth, TX (US); Christopher C Hoelscher, Arlington, TX (US); Richard Ellis Robey, Mansfield, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 205 days.

(21) Appl. No.: 16/436,507

(22) Filed: Jun. 10, 2019

(65) Prior Publication Data

US 2020/0386085 A1 Dec. 10, 2020

(51) Int. Cl.

| | |
|---|---|
| ***E21B 43/119*** | (2006.01) |
| ***E21B 43/116*** | (2006.01) |
| ***E21B 43/112*** | (2006.01) |
| ***E21B 47/024*** | (2006.01) |

(52) U.S. Cl.

CPC ..... *E21B 43/119* (2013.01); *E21B 43/116* (2013.01); *E21B 47/024* (2013.01); *E21B 43/112* (2013.01)

(58) Field of Classification Search

CPC .... E21B 43/119; E21B 43/116; E21B 43/112; E21B 43/117

See application file for complete search history.

(56) References Cited

U.S. PATENT DOCUMENTS

| | | | | |
|---|---|---|---|---|
| 4,381,610 | A | 5/1983 | Kramer | |
| 5,259,466 | A | 11/1993 | Venditto et al. | |
| 5,360,066 | A * | 11/1994 | Venditto | E21B 43/119 166/250.1 |
| 8,365,814 | B2 | 2/2013 | Hill et al. | |
| 9,945,215 | B2 * | 4/2018 | Godfrey | E21B 43/119 |
| 2010/0133004 | A1 * | 6/2010 | Burleson | E21B 47/117 175/2 |
| 2011/0132607 | A1 | 6/2011 | Lahitette et al. | |
| 2012/0193143 | A1 * | 8/2012 | Hill | E21B 43/119 175/4.51 |
| 2017/0082766 | A1 | 3/2017 | Milne et al. | |
| 2018/0328120 | A1 * | 11/2018 | Therrien | E21B 17/023 |

OTHER PUBLICATIONS

International Search Report & Written Opinion in International Application No. PCT/US2019/036381, dated Mar. 12, 2020.

Machine Translation into English of RU 2241823 C2, Method for Directing Cumulative Charges (Variants), Directed Shooting Perforator (Variants), Method for Placing Well Component (Variants), Rigid Centering Holder, Device for Measuring Direction, Applicant was unable to locate RU 2241823 C2 original Russian-language document.

* cited by examiner

*Primary Examiner* — Michael R Wills, III

(74) *Attorney, Agent, or Firm* — McGuireWoods, LLP

(57) ABSTRACT

A perforating system and method includes a perforating gun with shaped charges and an orientation device. The orientation device provides an orientation datum. Sensors associated with the perforating gun detect relative alignment of each perforating gun as compared to the orientation datum. A detonation signal can be either sent or not sent to the perforating gun in response to the signal received from the orientation sensor.

16 Claims, 5 Drawing Sheets

ORIENTED DETECTION PERFORATING DEVICE

BACKGROUND

The present disclosure relates generally to the field of oil and gas production and more specifically to apparatus and methods for aligning perforating charges within a wellbore. The present disclosure further concerns apparatus and methods for confirming the alignment of perforating charges prior to detonating the perforating charge.

After a wellbore is drilled it is generally completed by inserting a casing into the wellbore, which is then cemented into place by pumping cement into the annular space between the wellbore and the casing. The cemented casing isolates the earth formations penetrated by the wellbore from each other. Thus any hydrocarbon-bearing strata, such as oil or gas reservoirs, are isolated from the rest of the formations. Perforating systems are used for making fluid communication passages, referred to as perforations, from the wellbore to the desired strata, such as strata containing hydrocarbons.

Perforating systems typically comprise one or more perforating guns strung together, these strings of guns can sometimes exceed a thousand feet of perforating length. Contained within the perforating guns are multiple shaped charges that typically include a charge case, a liner, and a quantity of explosive inserted between the liner and the charge case. When the explosive is detonated, the force of the detonation collapses the liner and ejects it out one end of the charge at a high velocity in a contained pattern called a "jet". The jet penetrates the casing, the cement and a quantity of the formation, thereby forming a perforation into the formation that enables fluid communication between the wellbore and its surrounding formation.

The shaped charges are preferably aimed in a particular direction for maximum penetration of a hydrocarbon producing formation and to avoid shooting into areas having undesirable contents, such as a water-bearing zone. In a vertically drilled wellbore the formations are generally located in a perpendicular relationship relative to the wellbore, therefore a location "up-hole" within the wellbore generally relates to a formation having a shallower depth while a location "down-hole" within the wellbore generally relates to a formation having a deeper depth. In such a vertically drilled wellbore perforating into a particular desired formation is generally just a matter of adjusting the depth within the wellbore and perforating within the plane of the desired formation. In this example the orientation of the charges are not very relevant, as each perforation extends into the desired formation.

In a horizontally drilled wellbore, a location up-hole within the wellbore will generally not relate to a formation having a shallower depth, and the orientation of perforations can be more critical. In a simplified example, consider a horizontal wellbore drilled within an oil containing formation having a gas cap located above the oil zone and a water zone located below the oil zone. In such a well the optimum orientation of the perforations would be within a horizontal plane extending into the oil bearing layer. A perforation extending from the wellbore in a vertical upward direction would have an increased possibility of extending into the gas cap located above the oil layer, and likewise a perforation extending from the wellbore in a vertical downward direction would have an increased possibility of extending into the water bearing zone located below the oil layer. These concerns are increased when a well is considered for fracturing of the formation, as the induced fracture can further extend the fluid communication into an undesirable direction if the perforations are not oriented correctly.

Aiming of the shaped charges can be accomplished by aligning the perforating gun in a particular orientation. One manner of accomplishing perforating gun orientation is to asymmetrically load a perforating gun so that the loading will cause the gun to rotate into the desired orientation. For example, with use of an increased weight in one portion of the gun, where the weight is attached to the shape charge tube carrier and gravity will act to position the weighted section at the bottom of the wellbore. The orientation can be accomplished with an externally oriented system which uses devices and weights that are external to the perforating gun. Externally oriented systems are exposed to the casing environment and can add friction to the system created by external guns moving axially down the casing wall and can also be restricted by the design of the casing/completion string. Internally oriented system which do not use devices and weights that are external to the perforating gun can be used that can allow perforating in any direction irrespective of the gun's position relative to the casing. Internally oriented systems are also less exposed to the casing environment and do not impose additional friction to the system as opposed to external systems. An example of an internal oriented system is the G-Force® System offered by Halliburton.

In some instances however, in spite of the asymmetric loading the guns may stick within the casing and not freely rotate into the desired orientation. Even with use of an internal oriented system it would be desirable to have a means of verifying the orientation prior to perforating. Whether an internal oriented system, external oriented system, or some alternate means of orienting a perforating gun is employed, it is desirable to have a perforating system and methods to verify the orientation of the perforating gun charges and adjust such orientation if needed.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

Figure 1:
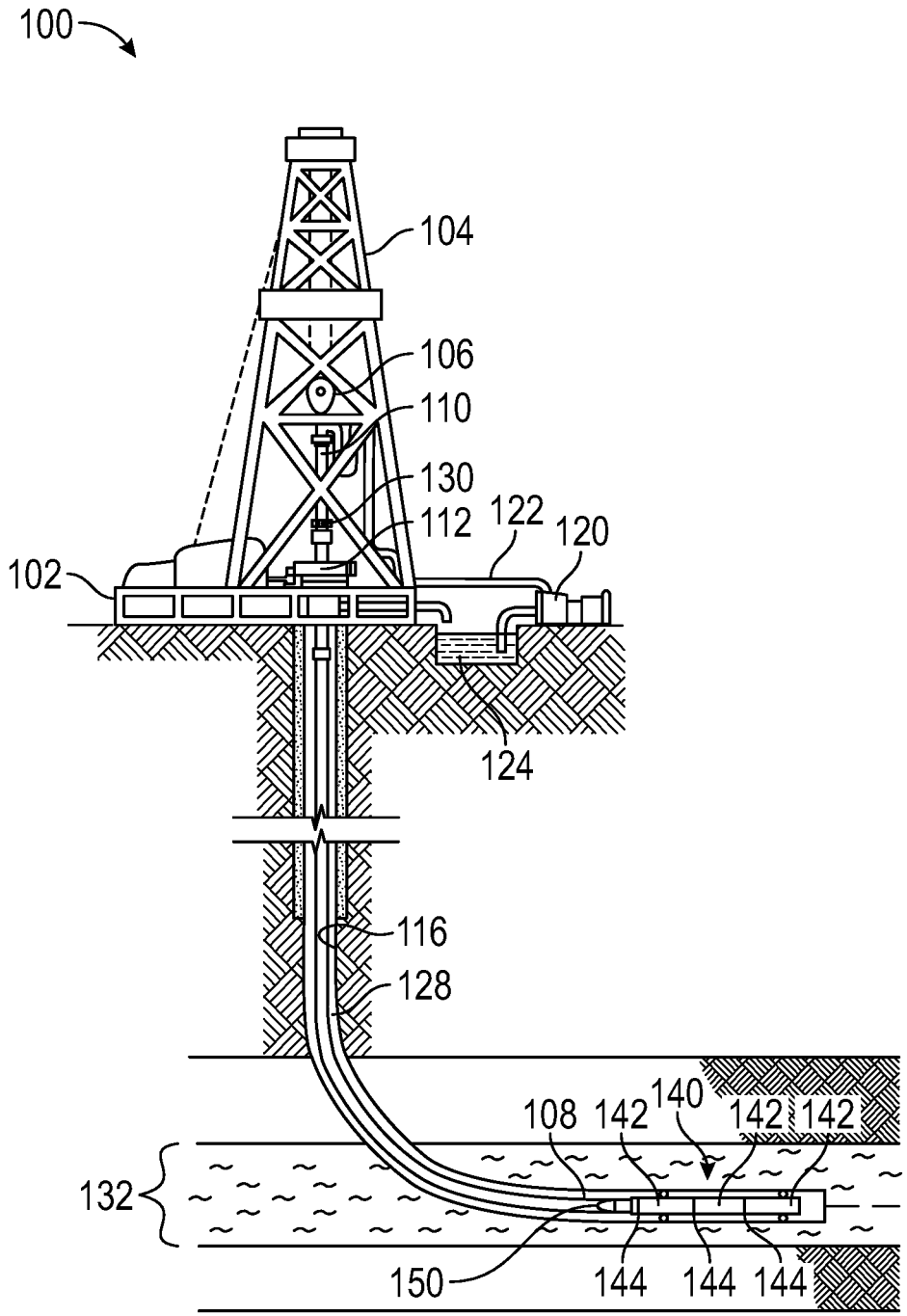
FIG. 1 illustrates a land-based oil and gas rig including a downhole orientation system in an illustrative perforating environment according to an embodiment of the present disclosure.

While certain embodiments and aspects of the subject technology are depicted in the drawings, those skilled in the art will appreciate that the embodiments and aspects depicted are illustrative and that variations of those shown, as well as other embodiments and aspects described herein, may be envisioned and practiced within the scope of the present disclosure.

DETAILED DESCRIPTION

The following detailed description illustrates embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques. Therefore, the description that follows is not to be taken as limiting on the scope or applications of the appended claims. In particular, an element associated with a particular embodiment should not be limited to association with that particular embodiment but should be assumed to be capable of association with any embodiment discussed herein.

Various elements of the embodiments are described with reference to their normal positions when used in a borehole. For example, a screen may be described as being below or downhole from a crossover. For vertical wells, the screen will actually be located below the crossover. For horizontal wells, the screen will be horizontally displaced from the crossover, but will be farther from the surface location of the well as measured through the well. Downhole or below as used herein refers to a position in a well farther from the surface location in the well.

The present disclosure relates generally to the field of oil and gas production and more particularly to apparatus and methods for aligning perforating charges. The present disclosure further concerns apparatus and methods for confirming the alignment of perforating charges prior to detonating the perforating charge.

The disclosure provides alternative ways or methods to align perforating charges. For example, the subject technology, as described herein, can provide one or more orientation datum within the perforating tool string that provides a reference point for which to compare the alignment of a perforating gun orientation to. The orientation datums can include any of a variety of configurations all within the scope of this disclosure, including but not limited to one orientation datum serving multiple perforating guns or the entire string, or one orientation datum per individual perforating gun. The orientation datum can be determined through a variety of means, such as, a weighted mandrel reacting to gravitational forces, or the use of an electromagnetic device such as an accelerometer or a potentiometer as non-limiting examples. The orientation of the perforating charges can then be determined and compared to the orientation datum. The orientation of the perforating charges can then be verified if they are within an acceptable range to proceed with detonating. The orientation of the perforating charges can be used in determining whether a particular perforating gun should be detonated or whether it should be bypassed.

Referring to the drawings in detail, wherein like numerals denote identical elements throughout the several views, there is shown in FIG. 1, a land-based drilling rig 100 including a downhole orientation system 150 that may be used in an illustrative wellbore application, according to the one or more embodiments. It should be noted that, even though FIG. 1 depicts a land-based rig 100, the exemplary downhole orientation system 150, and its various embodiments disclosed herein, are equally well suited for use in or on other types of rigs, such as offshore platforms or rigs arranged in any other geographical location.

As illustrated in FIG. 1, a drilling platform 102 supports a derrick 104 having a traveling block 106 for raising and lowering a tubing string 108. A kelly 110 supports the tubing string 108 as it is lowered through a rotary table 112. The kelly 110 is configured to transfer rotary motion to a turntable 130 and the tubing string 108. When in a drilling mode a drill bit (not shown) can be located at the distal end of the tubing/drill string 108 that is driven either by a downhole motor and/or via rotation of the drill string 108 from the well surface. As the bit (not shown) rotates, it creates a wellbore 116 that passes through various subterranean formations 118. A pump 120 circulates drilling/completion fluid through a pipe 122 to the kelly 110, which conveys the drilling/completion fluid downhole through the tubing string 108 and through orifices in the drill bit. The drilling/completion fluid is then circulated back to the surface via an annulus 128 surrounding the tubing string 108 where it is eventually returned to the surface and deposited in a pit 124. The drilling fluid transports cuttings and debris derived from the wellbore 116 into the pit 124 and aids in maintaining the integrity of the wellbore 116. The entire wellbore 116 may be cased or portions of it may be uncased, referred to as an open hole completion.

As shown in FIG. 1, an illustrative example of a perforating tool string 140 containing a series of perforating guns 142 are located at the distal end of the tubing 108, within a desired formation 132. In this example of a tubing conveyed perforating system, the tubing 108 may be able to have rotational movement supplied by the turntable 130 or by some other means. Each perforating gun 142, or string of guns, is capable of containing a downhole orientation sensor 144, according to the one or more embodiments. There is also an orientation datum 150 within the perforating tool string 140 that provides a reference point for which to align the perforating gun 142 orientation to. As used herein the term "sensor" is used in a generic manner and could include a variety of embodiments, such as electrical sensors or transmitters, mechanical devices such as a pass/fail mechanism that ensures an orientation within a specific degree range, as well as others.

Figure 2:
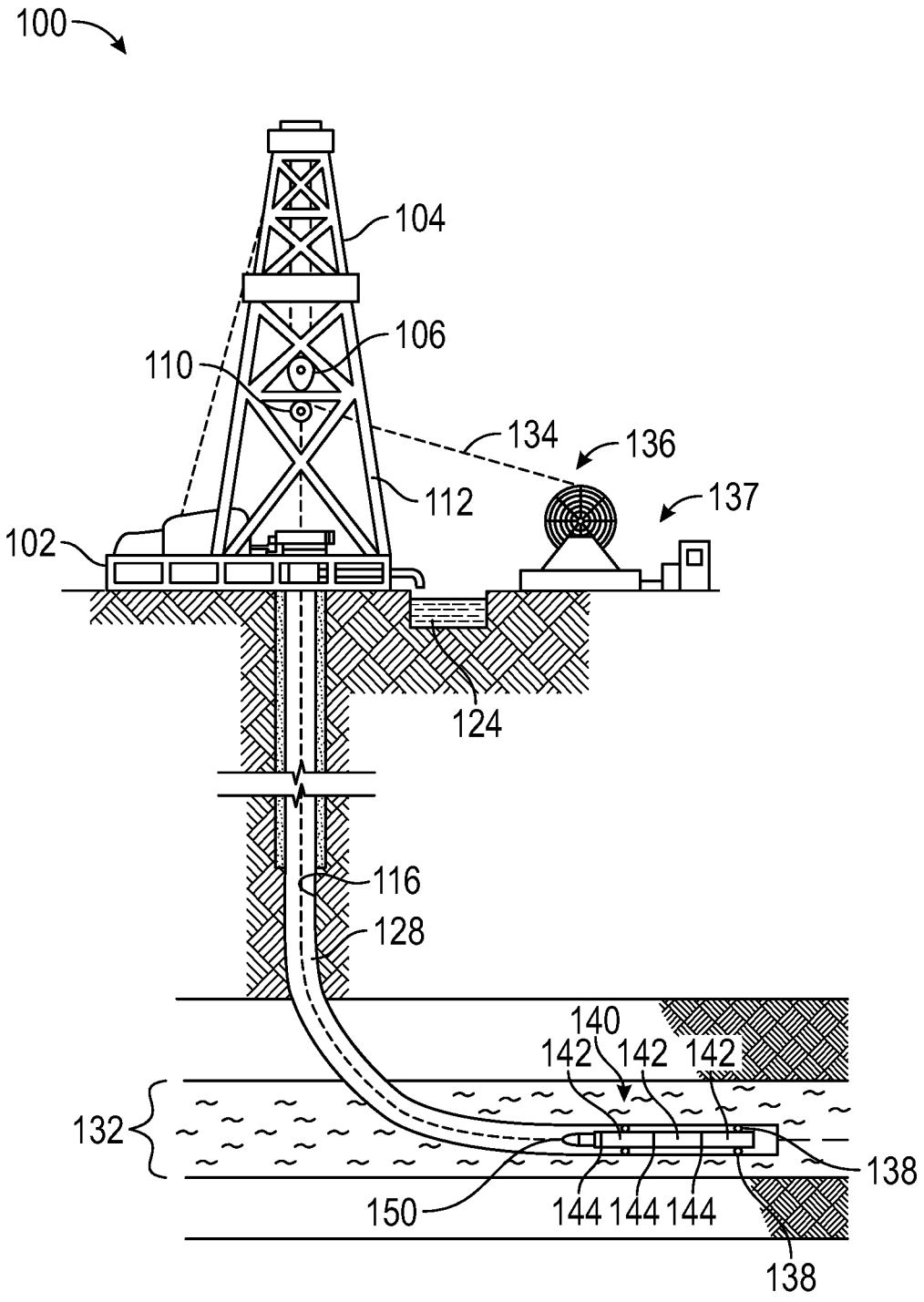
FIG. 2 illustrates a land-based oil and gas rig including a downhole orientation system in an illustrative perforating environment according to an embodiment of the present disclosure.

As illustrated in FIG. 2, the drilling rig 100 is shown having a wireline 134 extending from a winch 136 that conveys the perforating tool string 140 into the wellbore 116. The perforating guns may be assisted in reaching out to the distal end of the wellbore 116 with the help of a tractor device 138, or pressure pumping known as pump-down. An optional control unit 137 can be included to control the winch 136, the tractor device 138, and can process the information received by the perforating tool string 140. FIGS. 1 and 2 show examples of tubing conveyed and wireline conveyed systems, but are not intended to be limiting to only these types of conveyance systems.

As shown in FIG. 2, the perforating tool string 140 containing a series of wireline conveyed perforating guns 142 are located at the distal end of the wellbore 116, each capable of containing a downhole orientation sensor 144, according to the one or more embodiments. There is also an orientation datum 150 within the perforating tool string 140 that provides a reference point for which to align the perforating gun 142 orientation to. In this wireline conveyed system there is no tubing string to impart rotational movement supplied by the rig 100. Other means of rotational movement can include those known to someone skilled in the art, for example, a weighted segment that can rotate with use of a bearing, wherein the weighted segment rotates with the force of gravity to align a portion of the tool string 140. Alternate examples of rotational movement can include, but are not limited to, motor driven rotating perforating charges inside a carrier with internally orienting systems, motor driven rotating perforating gun systems with externally orienting systems, and various combinations thereof.

Figure 3:
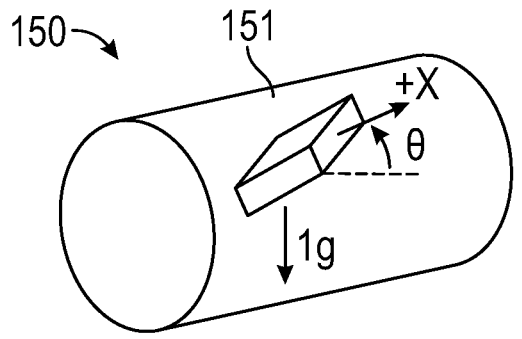
FIG. 3 illustrates an orientation datum containing an electromagnetic device in accordance with an embodiment of the present disclosure.

Referring now to FIG. 3, an embodiment of an orientation datum 150 includes an electromagnetic device 151. The orientation datum 150 can be housed within a perforating gun 142 or can be a separate sub component. In the example shown in FIG. 3 the electromagnetic device 151 can include an accelerometer and/or a potentiometer. The sub component housing the electromagnetic device 151 can be considered the datum orientation and can be connected to the rest of the perforating string. The perforating guns can be connected to the datum such that the relative alignment of the perforating charge phasing angle is known. If the perforating guns are gravity oriented, which may be referred to as G-Force type guns, then the alignment can be determined relative to an "up" or "down" datum.

Figure 4:
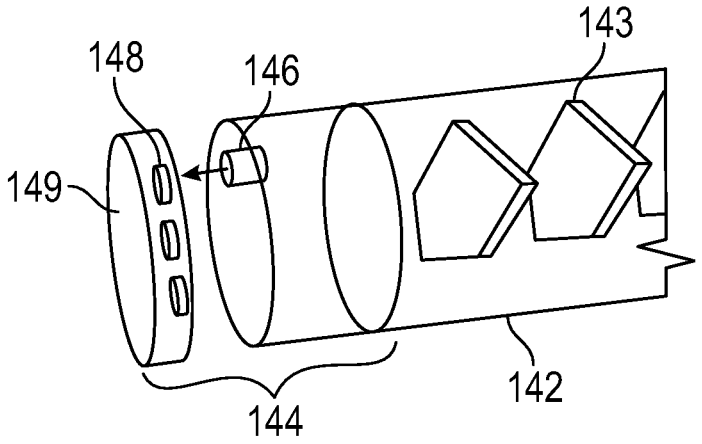
FIG. 4 illustrates an orientation sensor containing a light source and sensor elements, in accordance with an embodiment of the present disclosure.

Referring now to FIG. 4, illustrated is an embodiment of an orientation sensor 144 that includes a light source 146 and sensor elements 148 that are attached to a perforation gun 142 containing individual perforation charges 143. In an embodiment, attached to each gun is an orientation sensor 144 that transmits a reading from a self-aligning ring 149 that rotates on a bearing by means of a weighted segment. The sensor may be a photoelectric device such as a light source 146 and a sensor element 148. The sensor elements 148 can be affixed to a stationary element while the light source 146 is affixed to the perforation gun 142. The elements can be uniquely identified and arranged in a circular array that is associated with a specific angular position. The location of the light source and elements can be reversed so that the light is stationary and the elements are attached to the rotating charge tube. As the light source 146 and a sensor element 148 align, verification of the orientation of the perforation charges 143 can be made. In an embodiment the light source 146 and sensor elements 148 can be attached to an externally oriented gun. In an embodiment the light source 146 and sensor elements 148 can be attached to an internally rotating component of an internally oriented gun.

Figure 5:
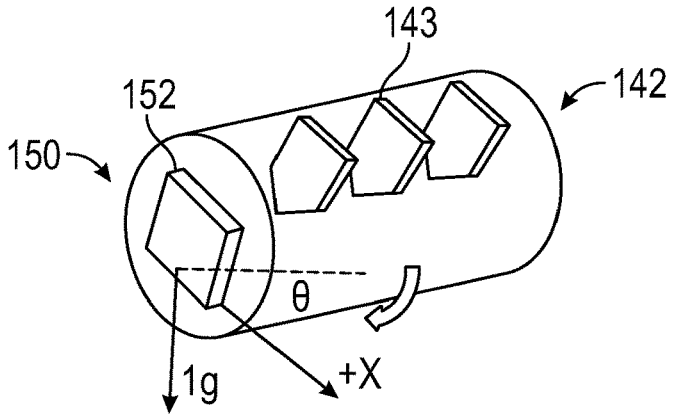
FIG. 5 illustrates an orientation datum containing an accelerometer, in accordance with an embodiment of the present disclosure.

Referring now to FIG. 5, illustrated is an embodiment of an orientation datum 150 consisting of an accelerometer 152 that is attached to the perforation gun 142 containing individual perforation charges 143. The readings from the accelerometer 152 can provide verification of the orientation of the perforation charges 143. The perforating gun 142 can be referenced to the datum 150 such that the relative alignment of the perforating charge 143 phasing angle is known.

Figure 6:
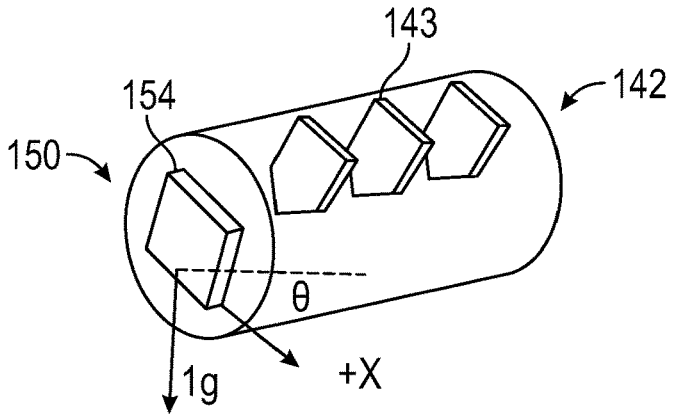
FIG. 6 illustrates an orientation datum containing a potentiometer, in accordance with an embodiment of the present disclosure.

Referring now to FIG. 6, illustrated is an orientation device 150 consisting of a potentiometer 154 that is attached to the perforation gun 142 containing individual perforation charges 143. The readings from the potentiometer 154 can provide an orientation of the perforation charges 143. The perforating gun 142 can be referenced to a datum (such as shown in FIG. 7) such that the relative alignment of the perforating charge 143 phasing angle is known.

Figure 7:
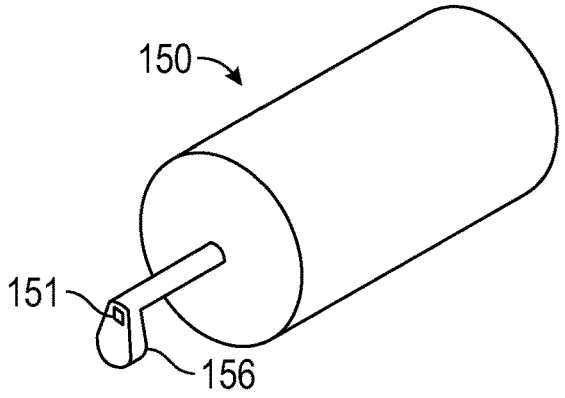
FIG. 7 illustrates an orientation datum including a weighted mandrel that can include an electromagnetic device, in accordance with an embodiment of the present disclosure.

Referring now to FIG. 7, illustrated is an embodiment of an orientation datum 150 consisting of a weighted mandrel 156 that can contain an electromagnetic device 151. In embodiments the electromagnetic device 151 can be a potentiometer. Readings from the electromagnetic device 151 can provide verification of the orientation of the orientation datum 150. In an embodiment the orientation datum 150 of FIG. 6 is coupled to an independent mechanical gravity reference such as a weighted mandrel 156 of FIG. 7 which is taken as an absolute orientation. The readings from the potentiometer 154 can provide verification of the orientation of the perforation charges 143. The perforating gun 142 can be referenced to the datum 150 such that the relative alignment of the perforating charge 143 phasing angle is known. The electromagnetic device 151 can be a potentiometer attached to the weighted mandrel 156 that is determined to be absolute. Measurements from a different potentiometer (such as shown in FIG. 6) can be compared to the measurements from the weighted mandrel 156 to determine the orientation of the perforation charges 143.

Figure 8A:
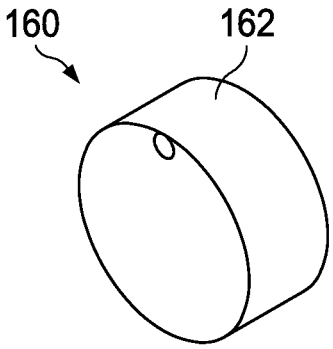
FIG. 8 illustrates an alternate means of using a weighted element to indicate the downward orientation of natural gravitational force.
Figure 8B:
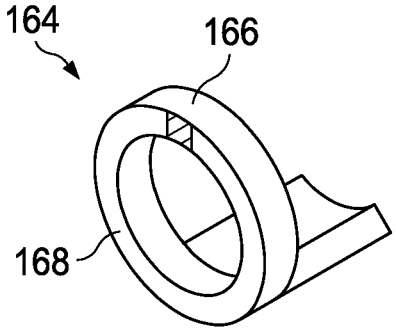

Referring now to FIG. 8, illustrated is an embodiment of an alternate means of using a weighted element to indicate the downward orientation of natural gravitational force. In FIG. 8A an electrical contact point 162 is located on an element 160 that can be rigidly connected to a perforation charge tube or to an element thereof, to indicate the orientation of the perforation charges. In FIG. 8B a weighted ring 164 can include an electrical contact to switch 166 and an electrical contact to bypass 168. When the element 160 and weighted ring 164 are aligned such that the electrical contact point 162 and electrical contact to switch 166 are in contact, then a signal can be sent to verify the orientation of the element 160 and weighted ring 164. When the alignment is rotationally offset by more than a predetermined amount, then the electrical contact point 162 and electrical contact to bypass 168 will be in contact and a signal can be sent to verify the orientation of the element 160 and weighted ring 164 is offset. If the orientation of the element 160 and weighted ring 164 is offset, the perforating charges affiliated with this means of orientation verification can be bypassed and the charges not set off.

Figure 9:
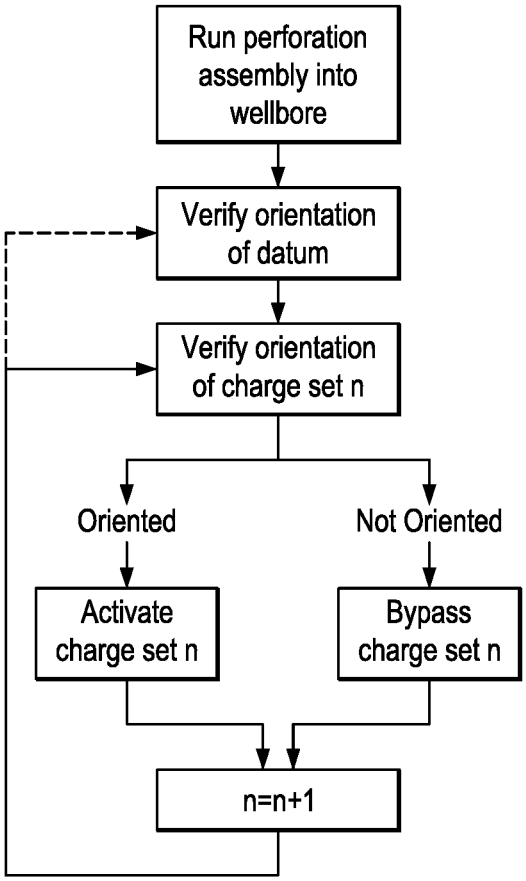
FIG. 9 illustrates a block diagram of a downhole orientation system.

Referring now to FIG. 9, illustrated is a block diagram of the downhole orientation system 150, according to one or more embodiments of the disclosure. The perforation assembly is prepared and run into the wellbore. The orientation datum is verified, and then the orientation of the first set of perforation charges is verified. If the relative orientation is acceptable, the charges can be activated and the first set of perforations are made. If the relative orientation is not acceptable, then the first set of perforation charges are bypassed (not set off) and attention is directed to the next set of perforation charges. The work string can optionally be articulated between the sets of perforations being verified or fired, to observe any additional sets have achieved acceptable orientation. In case the movement from setting off a previous set of perforation charges altered the relative orientation, articulating the work string can re-orient the misaligned perforators.

An acceptable or desired orientation can be an angular range relative to a datum. The criteria of a desired orientation can be dependent on the individual well and the particular zones the wellbore is located in. The presences of a gas cap or a water level are non-limiting factors that can influence whether the perforating gun orientation should be limited. The wellbore being located within a thin productive zone, such as a thin shale zone, may influence the decision of what an acceptable range of orientation should be. The wellbore being located near a boundary of a productive zone, such as located near an upper boundary or lower boundary of a shale zone, may influence the decision of what an acceptable range of orientation should be.

In an illustrative embodiment the angular range can vary depending on whether an up direction or down direction, as measured from a horizontal datum. A deviation in the up direction would be angled in a direction towards the surface, or away from a gravitational force. A deviation in the down direction would be angled in a direction away from the surface, or towards the direction of a gravitational force. As used herein a 10° variation in the up direction would have the perforating charges aligned in a direction that is 10° above a horizontal datum. A 10° variation in the down direction would have the perforating charges aligned in a direction that is 10° below a horizontal datum.

In an embodiment an acceptable orientation may range from 0° to 90° deviation from a datum, optionally from 0° to 60° deviation from the datum, optionally from 0° to 45° deviation from the datum, optionally from 0° to 30° deviation from the datum, optionally from 0° to 20° deviation from the datum, optionally from 0° to 10° deviation from the datum, optionally from 0° to 5° deviation from the datum, optionally from 0° to 2° deviation from the datum.

In an embodiment a limitation relative to the up direction may be restricted due to the presence of a geological feature or well construction feature. Such features may include, but are not limited to, stress planes, gas cap, oil, water zones, control line, fiber optic, gauges, tubing, etc. Such feature located above the wellbore which is to be avoided. In this embodiment the acceptable angular range relative to the up direction may be limited to no more than 10° deviation from a horizontal datum, while the acceptable angular range relative to the down direction may be from 0° to 90° deviation from the horizontal datum.

In an embodiment a limitation relative to the down direction may be restricted due the presence of a geological feature or well construction feature. Such features may include, but are not limited to, stress planes, gas cap, oil, water zones, control line, fiber optic, gauges, tubing, etc. Such feature located below the wellbore which is to be avoided. In this embodiment the acceptable angular range relative to the down direction may be limited to no more than 10° deviation from a horizontal datum, while the acceptable angular range relative to the up direction may vary up to 30°, 45°, 60°, or up to 90° deviation from a horizontal datum.

An embodiment of the present disclosure is a perforating system that includes at least one perforating gun, each having at least one shaped charge and an orientation device that provides an orientation datum. Orientation sensors can be associated with one or more perforating guns to detect relative alignment of each perforating gun as compared to the orientation datum. For example, in one configuration there may be at least one orientation sensor per perforating gun to detect the relative alignments of those respective perforating guns and to selectively generate signals depending on the orientation.

A controller in communication with the orientation sensors is configured to provide detonation signal(s) to the perforating guns for which the signals received from the orientation sensors indicate a desired orientation of those perforating guns. The signal and control logic may be configured in any of a variety of different ways, and this disclosure is not intended to be limited to any particular one of the following examples. In a first example, the orientation sensors may each generate a positive signal in response to a desired alignment of the associated perforating gun (e.g. alignment within a predetermined desired range of alignment), and the controller may be configured to send the detonation signal to just the perforating guns for which a signal was received indicating the desired alignment. In a second example, an orientation sensor may additionally or alternately generate a signal indicating an undesired alignment (e.g. alignment outside of a predetermined desired range of alignment), and the controller may be configured to avoid sending the detonation signal to those associated perforating guns. In a third example, the controller may interpret a lack of any signal from an orientation sensor as an implied indication of an undesired orientation, and thus, to only send the detonation signal to those perforating guns for which a signal was received at all from the associated orientation sensors.

In an embodiment the orientation device can consist of an accelerometer or optionally can be a potentiometer, which can operate in response to a gravitational force. The desired orientation can be an angular range relative to the datum. A sensor can be associated with each perforating gun that includes a light source and sensor elements, wherein the light source and sensor elements provide a range of readings indicating the relative orientation of the perforating gun. In an embodiment the light source can be affixed to the perforating gun and the sensor elements can be part of a self-aligning ring that rotates by means of a weighted segment. In an embodiment the sensor elements can be affixed to the perforating gun and the light source is part of a self-aligning ring that rotates by means of a weighted segment.

An embodiment of the present disclosure is a method of perforating a wellbore that includes inserting into a wellbore a perforation tool string, the perforation tool string having perforating guns with perforation charges and an orientation device, which can be an electromagnetic device. Taking readings from the orientation device provides an orientation datum. Taking readings from sensors associated with each perforating gun can detect relative alignment of each perforating gun as compared to the orientation datum. The signal received from each orientation sensor is checked to see if indicative of a desired orientation of the perforating gun. A detonation signal to the perforating gun is given only if the signal received from the orientation sensor is indicative of a desired orientation of the perforating gun. A perforating gun is bypassed if the signal received from the orientation sensor is indicative of an undesired orientation of the perforating gun.

In an embodiment the orientation device can consist of a Hall Effect sensor that is used to measure the magnitude of a magnetic field to indicate whether desired orientation has been attained. The desired orientation can be an angular range relative to a datum. A Hall Effect sensor can be associated with a perforating gun that includes a magnetic field source and the sensor providing a range of readings indicating the relative orientation of the perforating gun to the electromagnetic device. In an embodiment the Hall Effect sensor can be affixed to the perforating gun and the magnetic field source can be part of a self-aligning ring that rotates by means of a weighted segment. In an embodiment the magnetic field source can be affixed to the perforating gun and the Hall Effect sensor is part of a self-aligning ring that rotates by means of a weighted segment. In an embodiment the Hall Effect sensor can be used to orient off of one or more specific perforating tool component, such as by the rotational movement of a specific component in relation to the sensor. In this embodiment the metallic shoulder movement can be relative to the alignment of the perforating gun and indicate a relative orientation.

In an embodiment a mechanical method using a key and slot arrangement can be used as the orientation device. In one example only one of the key or slot are movable and if aligned the orientation of the perforating gun is validated. In an alternate embodiment both the key and slot are movable and able to rotate independently from each other. One feature (either the key or slot) is assumed to be oriented correctly, while the orientation of the other is dependent on the orientation of the charge. If the key and slot are aligned the orientation of the perforating gun is validated.

In an alternate embodiment the key and slot arrangement can be incorporated with a valve device to enable a pressure signal with the wellbore to be detected. If both the key and slot align, then the gun is determined to be sufficiently oriented, enabling either a vent or valve to be opened. The open vent or valve can enable fluid communication between the wellbore and the perforating gun. A pressure signal imposed within the wellbore can be detected by the perforating gun. The signal can be used to initiate a firing sequence within the perforating gun. In an embodiment the key and slot arrangement can be incorporated as part of the firing head assembly within the perforating gun.

The text above describes one or more specific embodiments of a broader disclosure. The disclosure also is carried out in a variety of alternate embodiments and thus is not limited to those described here. The foregoing description of an embodiment of the disclosure has been presented for the purposes of illustration and description. It is not intended to be exhaustive or to limit the disclosure to the precise form disclosed. Many modifications and variations are possible in light of the above teaching. It is intended that the scope of the disclosure be limited not by this detailed description, but rather by the claims appended hereto.

The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein.

All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A perforating system comprising:

at least one perforating gun, each having at least one shaped charge;

an orientation device that provides one or more orientation datum by which orientations of a selected one or more perforating guns can be compared;

an orientation sensor associated with the one or more perforating guns to detect relative alignment of the one or more perforating guns as compared to the one or more orientation datum and generate signals indicative of the relative alignment, wherein the orientation sensor is at least one of an accelerometer, a potentiometer, Hall Effect sensor, and a light source and sensor element; and a controller in communication with the orientation sensor and configured to provide detonation signals to the one or more perforating guns in response to orientation sensor signals.

2. The perforating system of claim 1, wherein the controller provides a detonation signal to one or more perforating guns in response to an orientation sensor signal indicative of an acceptable orientation.

3. The perforating system of claim 1, wherein the controller does not provide a detonation signal to one or more perforating guns in response to an orientation sensor signal indicative of an unacceptable orientation.

4. The perforating system of claim 1, wherein the controller does not provide a detonation signal to one or more perforating guns in response to a lack of a signal being received from an orientation sensor.

5. The perforating system of claim 1, wherein the orientation device is selected from the group consisting of the accelerometer, the potentiometer, and a mechanical key and slot device.

6. The perforating system of claim 5, further comprising a valve device to enable a pressure signal with the wellbore to be detected.

7. The perforating system of claim 1, wherein the light source is affixed to the orientation of the charges, and the sensor element is part of a self-aligning ring that rotates by use of a weighted segment.

8. The perforating system of claim 1, wherein the sensor element is affixed to the orientation of the charges, and the light source is part of a self-aligning ring that rotates by use of a weighted segment.

9. A method of perforating a wellbore comprising:

inserting into a wellbore a perforation tool string, the perforation tool string comprising at least one perforating gun having perforation charges and an orientation device;

taking readings from the orientation device that provides an orientation datum by which the orientation of a selected one or more of perforating guns can be compared;

taking readings from an orientation sensor associated with the at least one perforating gun that detect relative alignment of the at least one perforating gun as compared to the orientation datum;

obtaining orientation data from at least one of an accelerometer, a potentiometer, Hall Effect sensor, and a light source and sensor element;

checking if the readings received from the orientation sensor is indicative of a desired orientation of the at least one perforating gun; and providing a detonation signal to the perforating gun in response to readings received from the orientation sensor.

10. The method of perforating the wellbore of claim 9 further comprising: providing a detonation signal from a controller to one or more perforating guns in response to an orientation sensor signal indicative of an acceptable orientation.

11. The method of perforating the wellbore of claim 9 further comprising: not providing a detonation signal from a controller to one or more perforating guns in response to an orientation sensor signal indicative of an unacceptable orientation.

12. The method of perforating the wellbore of claim 9 further comprising: not providing a detonation signal from a controller to one or more perforating guns in response to a lack of a signal being received from an orientation sensor.

13. The method of perforating the wellbore of claim 9 further comprising: obtaining electromagnetic readings that provide orientation data from the orientation device.

14. The method of perforating the wellbore of claim 9 further comprising: obtaining orientation data from the orientation device operating in response to a gravitational force.

15. The method of perforating the wellbore of claim 9 further comprising: obtaining orientation data from the orientation device that comprises a mechanical key and slot device.

16. The method of perforating the wellbore of claim 15 further comprising: detecting a pressure signal with the wellbore utilizing a valve device in conjunction with the mechanical key and slot device.

* * * * *